US009010223B2

(12) United States Patent
Huang

(10) Patent No.: US 9,010,223 B2
(45) Date of Patent: Apr. 21, 2015

(54) TOOL BIT

(71) Applicant: New Way Tools Co., Ltd., Taichung (TW)

(72) Inventor: Ping-Wen Huang, Taichung (TW)

(73) Assignee: New Way Tools Co., Ltd., Taichung (TW)

( * ) Notice: Subject to any disclaimer, the term of this patent is extended or adjusted under 35 U.S.C. 154(b) by 274 days.

(21) Appl. No.: 13/760,138

(22) Filed: Feb. 6, 2013

(65) Prior Publication Data

US 2014/0216213 A1 Aug. 7, 2014

(51) Int. Cl.

| | |
|---|---|
| ***B25B 13/48*** | (2006.01) |
| ***B25B 15/00*** | (2006.01) |
| ***B25B 23/00*** | (2006.01) |

(52) U.S. Cl.
CPC ..... *B25B 15/005* (2013.01)

(58) Field of Classification Search
USPC ..... 81/52, 436, 438; 408/226–228
See application file for complete search history.

(56) References Cited

U.S. PATENT DOCUMENTS

| | | | | |
|---|---|---|---|---|
| 1,977,845 | A * | 10/1934 | Emmons | 76/108.2 |
| 3,393,722 | A * | 7/1968 | Windham | 81/438 |
| 5,704,261 | A * | 1/1998 | Strauch et al. | 81/467 |
| 5,868,047 | A * | 2/1999 | Faust et al. | 81/438 |
| 5,882,161 | A * | 3/1999 | Birkelbach | 411/387.7 |
| 5,884,541 | A * | 3/1999 | Habermehl et al. | 81/438 |
| 6,367,358 | B1 * | 4/2002 | Stacy | 81/436 |
| 6,520,055 | B1 * | 2/2003 | Reusch et al. | 81/460 |
| 7,168,348 | B2 * | 1/2007 | Holland-Letz | 81/460 |
| 7,437,979 | B1 * | 10/2008 | Wang | 81/436 |
| 8,418,587 | B2 * | 4/2013 | DeBaker | 81/436 |
| 8,516,932 | B2 * | 8/2013 | Wang | 81/436 |
| 2011/0283842 | A1 * | 11/2011 | Lai | 81/460 |

* cited by examiner

*Primary Examiner* — Hadi Shakeri
*Assistant Examiner* — Danny Hong
(74) *Attorney, Agent, or Firm* — Alan D. Kamrath; Kamrath IP Lawfirm, P.A.

(57) ABSTRACT

A tool bit includes a plurality of fins each having first and second ends and extended radially and longitudinally and including the second end thereof forming two opposite lateral sides each including a reinforcing section extended therefrom. Two adjacent fins of the plurality of fins form a recess therebetween, which has a curved periphery interconnecting two adjacent reinforcing sections of the two adjacent fins. Each fin defines a first length from the end thereof to the curved periphery of the recess extended from the second end thereof. The first length is smaller than a second length defined between two opposite peripheral sides of a hexagonal periphery of a connecting end of the tool bit.

14 Claims, 7 Drawing Sheets

TOOL BIT

BACKGROUND OF THE INVENTION

1. Field of the Invention

The present invention relates to a tool bit and, in particular, to a high torque tool bit.

2. Description of the Related Art

There are many types of tool bits. For example, PH, T, and S type etc. Generally, a conventional tool bit has a driving end for engaging with an object to be driven and a connecting end for engaging with a hand tool or a power tool, and the object includes a head including a slot inset therein for receiving the driving end. It is noticed that the driving end of the bit generally cannot fit steadily in the slot. Therefore, it causes an operator a difficulty to apply a larger torque to the object to be driven. The tool bit wobbles on the object even more seriously as it is driven faster.

The present invention is, therefore, intended to obviate or at least alleviate the problems encountered in the prior art.

SUMMARY OF THE INVENTION

According to the present invention, a tool bit has a first end and a second end longitudinally opposite the first end respectively defining a driving end for engaging with an object to be driven and a connecting end adapted to engage with a driving tool. A plurality of fins each have a first end and a second end and are formed on the driving end. Each of the plurality of fins is extended radially and longitudinally from the first end to the second end thereof. Each of the plurality of fins includes the second end thereof forming two opposite lateral sides each including a reinforcing section extended therefrom. Two adjacent fins of the plurality of fins form a recess therebetween, and the recess has a curved periphery interconnecting two adjacent reinforcing sections of the two adjacent fins. Each of the plurality of fins defines a first length defining a distance from first end thereof to the curved periphery of the recess extended from the second end thereof The first length is smaller than a second length defining a distance between two opposite peripheral sides of a hexagonal periphery of the connecting end. An extension is extended from the second end of each of the plurality of fins to the connecting end. The extension has a circular cross section. Each of the plurality of fins includes the two reinforcing sections extended therefrom extending in a circumferential direction of the extension.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
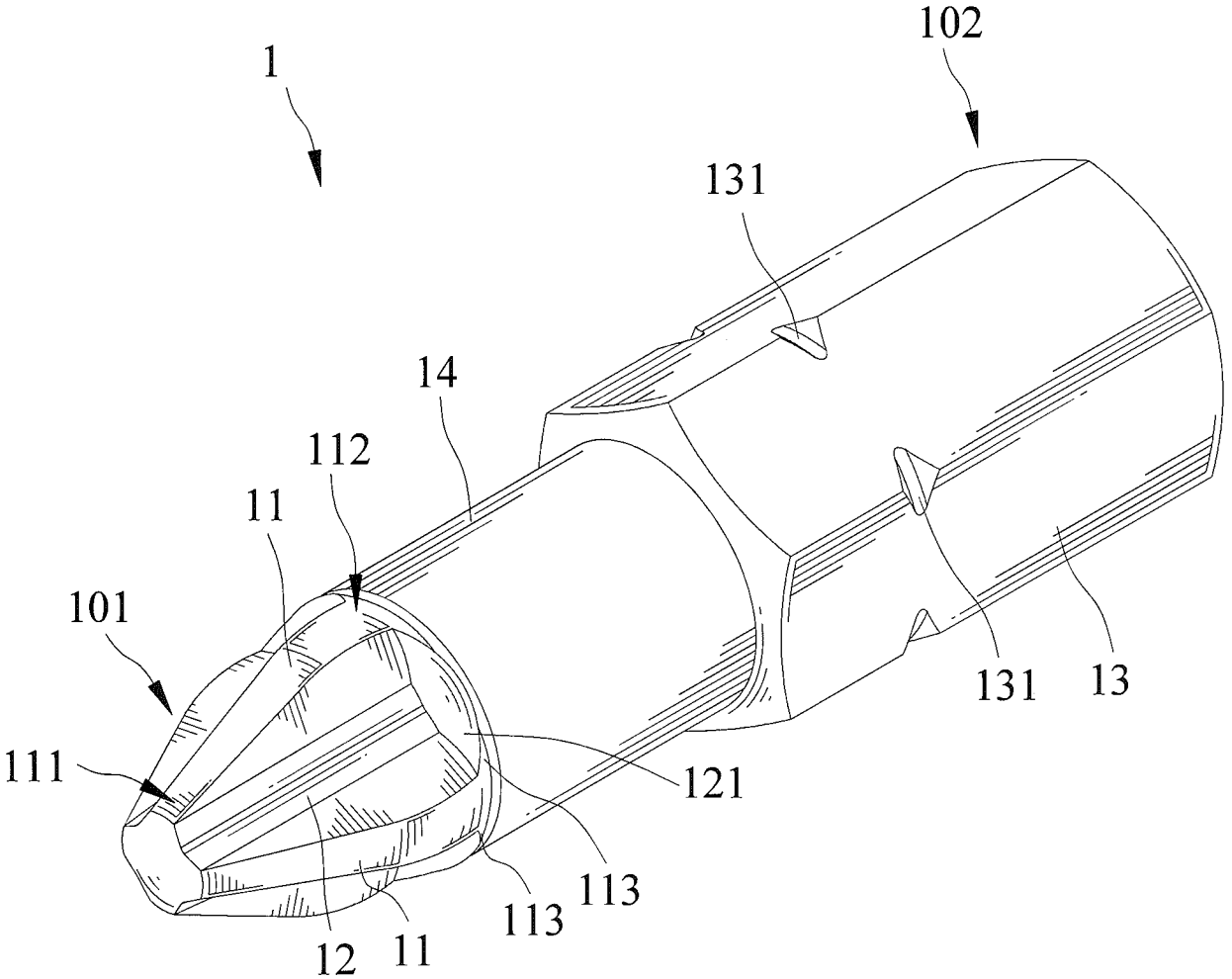
FIG. 1 is a perspective view of a tool bit in accordance with a first embodiment of the present invention.
Figure 2:
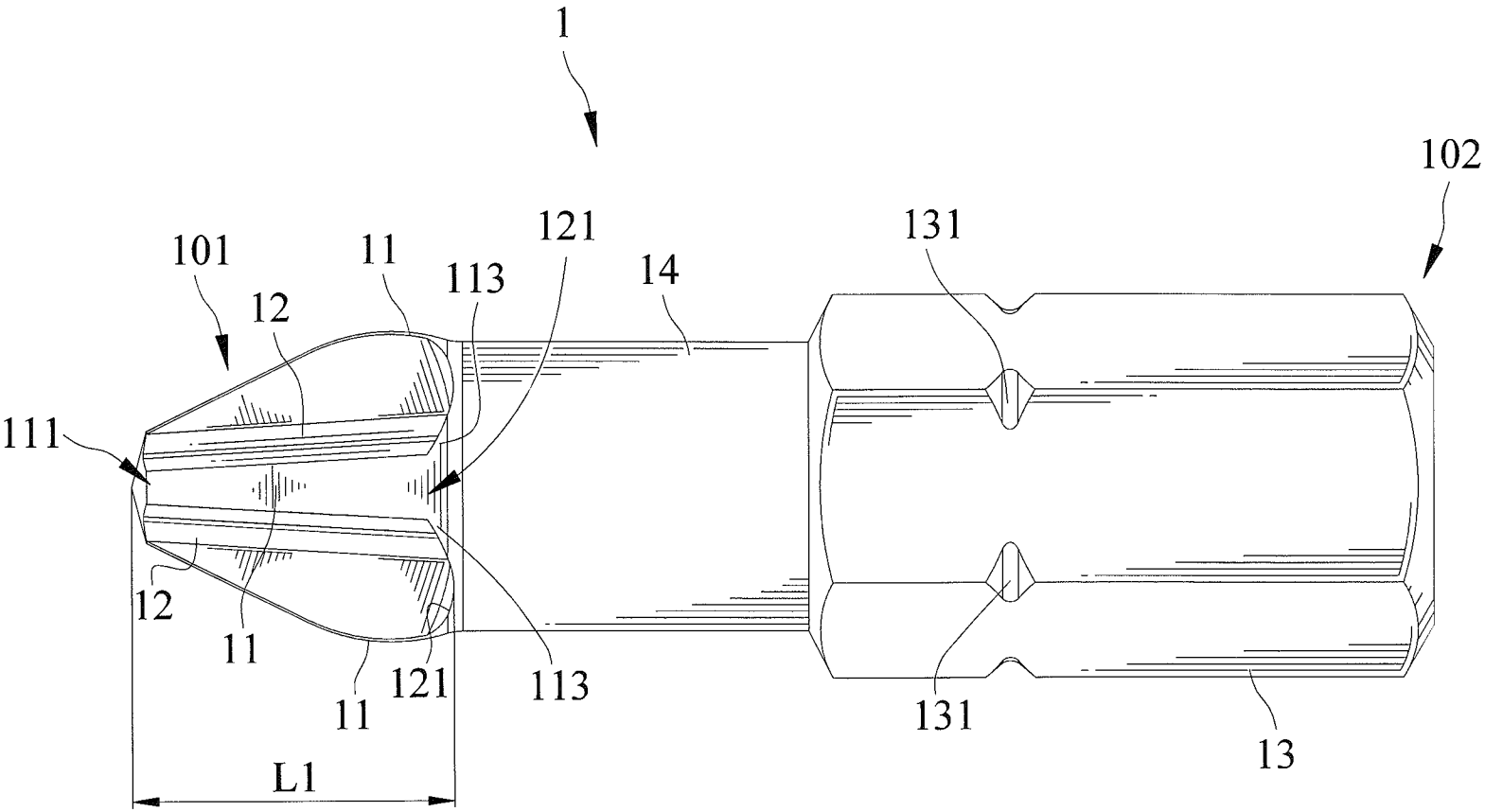
FIG. 2 is a side view of the tool bit of FIG. 1.
Figure 3:
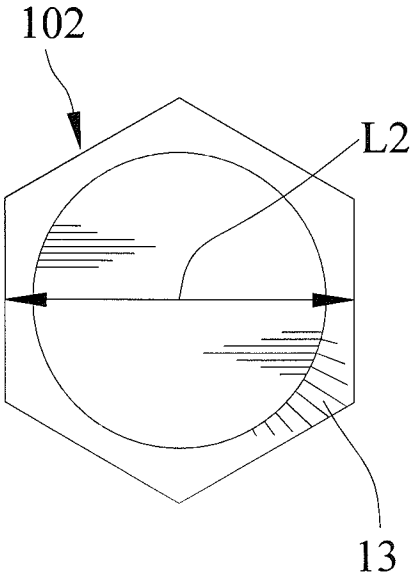
FIG. 3 is a rear view of the tool bit of FIG. 1.

FIGS. 1 through 6 show a tool bit in accordance with a first embodiment of the present invention. The tool bit 1 has a first end and a second end longitudinally opposite the first end respectively defining a driving end 101 for engaging with an object 2 to be driven and a connecting end 102 adapted to engage with a driving tool.

A plurality of fins 11 each have a first end 111 and a second end 112 and are formed on the driving end 101. Each of the plurality of fins 11 is extended radially and longitudinally from the first end 111 to the second end 112 thereof, thereby having an outer peripheral edge which extends obliquely and radially. Each of the plurality of fins 11 is extended radially out from the first end 111 to the second end 112 thereof Therefore, each of the plurality of fins 11 has an increased radial length from the first end 111 to the second end 112 thereof Each of the plurality of fins 11 includes the second end 112 thereof forming two opposite lateral sides each including a reinforcing section 113 extended therefrom. Two adjacent fins 11 of the plurality of fins 11 form a recess 12 therebetween, and the recess 12 has a curved periphery 121 interconnecting two adjacent reinforcing sections 113 of the two adjacent fins 11. Therefore, the driving end 101 is a characterized as Philips type (abbreviation: PH type). As the figure show, there are four fins 11 extended on the driving end 101. A connecting structure 13 forms the connecting end 102. The connecting structure 13 includes six peripheral sides and has a hexagonal cross section. Two adjacent peripheral sides of the connecting structure 13 cooperate to form a juncture edge, and one of a plurality of notches 131 is inset on the juncture edge. The notch 131 can receive a detent mechanism of the driving tool. Therefore, the tool bit 1 will not disengage from the driving tool easily.

Each of the plurality of fins 11 defines a first length L1 defining a distance from first end 111 thereof to the curved periphery 121 of the recess 12 extended from the second end thereof. The first length L1 ranges from 4.5 mm to 6.2 mm. The first length L1 is smaller than a second length L2 defining a distance between two opposite peripheral sides of the body 13 of the connecting end 102. The second length L2 ranges from 4 mm to 6.35 mm.

An extension 14 is extended from the second end 112 of each of the plurality of fins 11 to the connecting end 102. The extension 14 has a circular cross section. Each of the plurality of fins 11 includes the two reinforcing sections 113 extended therefrom extending in a circumferential direction of the extension 14. The plurality of fins 11, the curved periphery of the recess 12, the connecting structure 13, and the extension 14 are integrally formed as one-piece structure.

Figure 4:
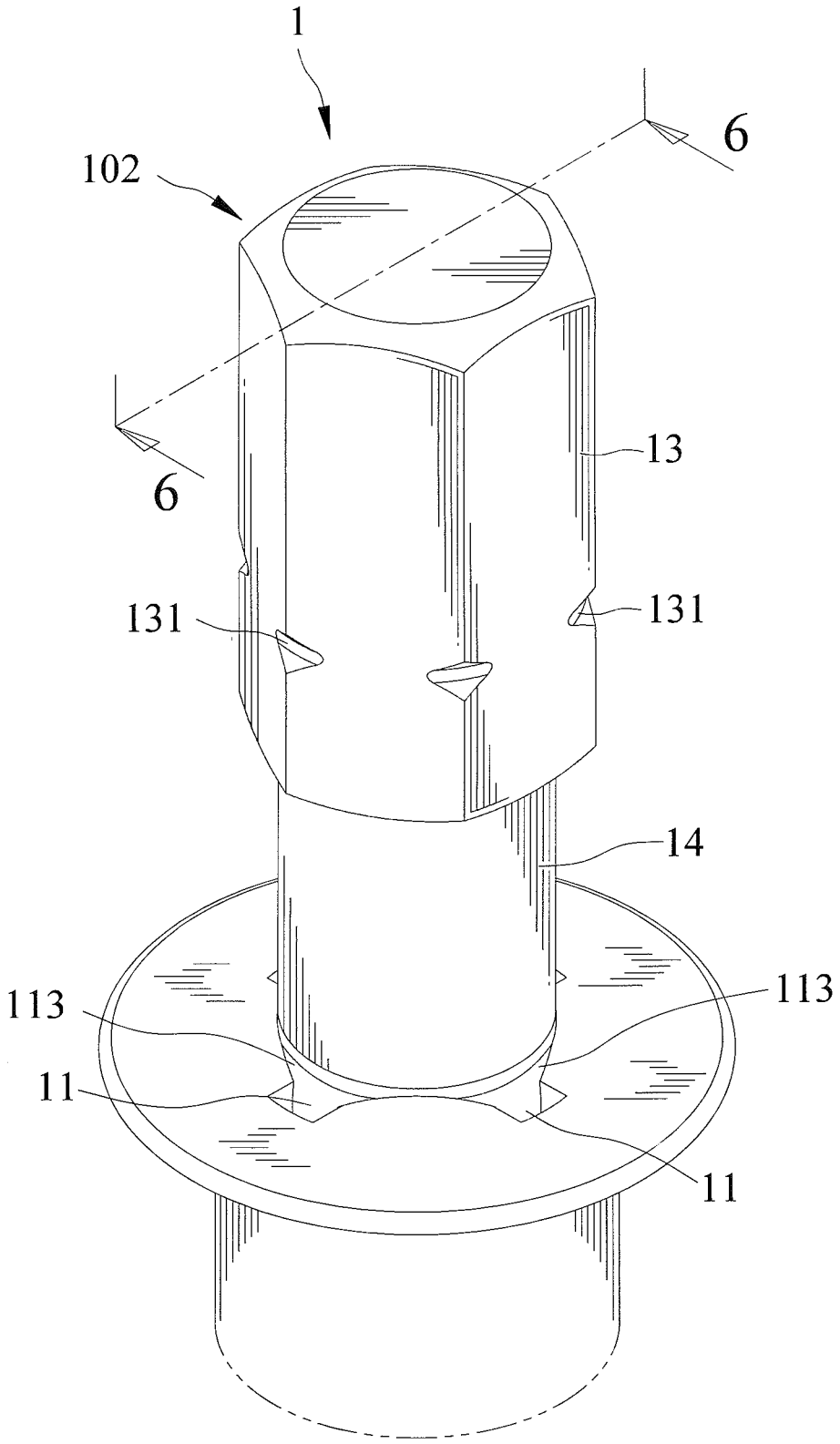
FIG. 4 illustrates the tool bit of FIG. 1 engaging with an object to be driven.
Figure 5:
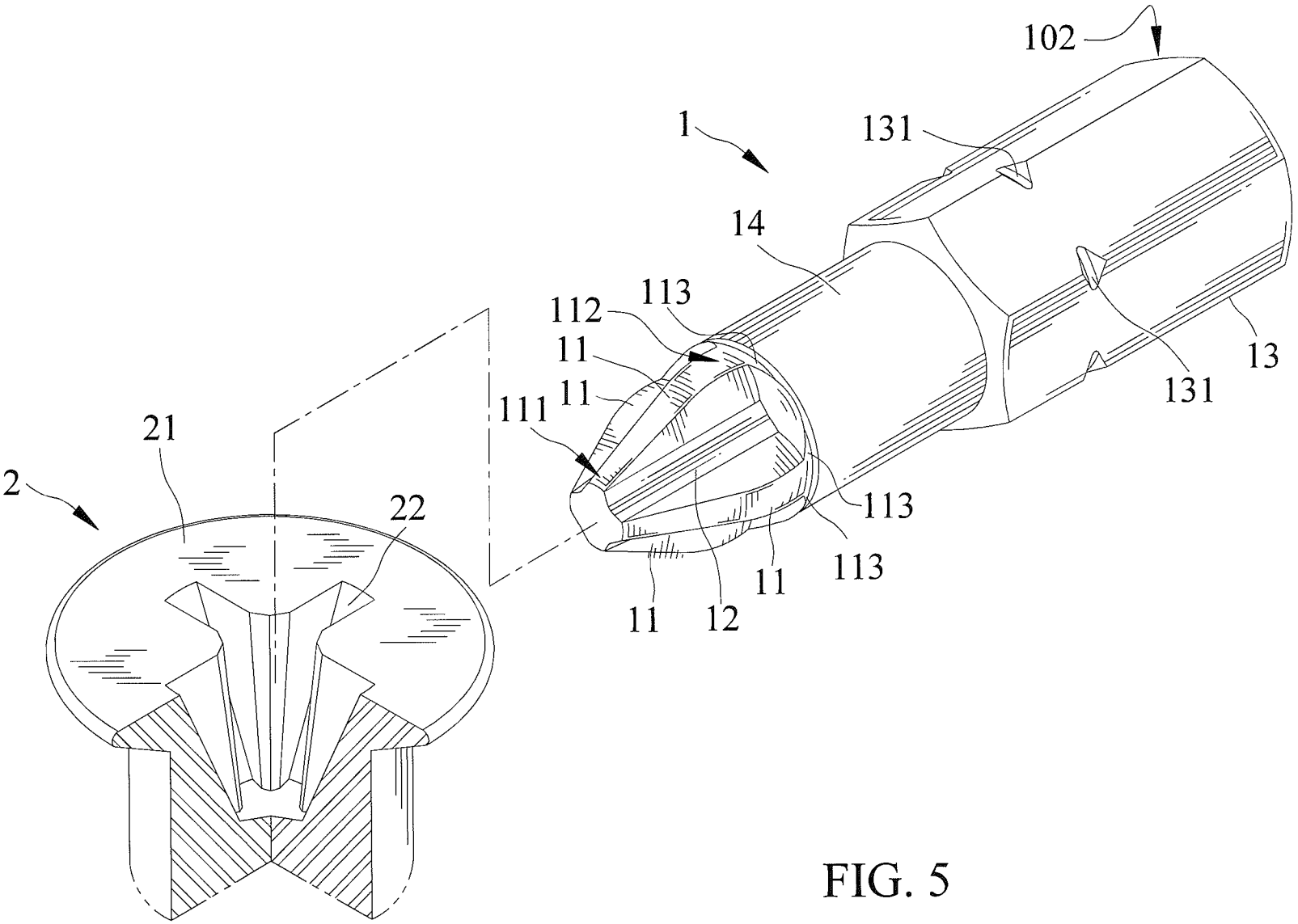
FIG. 5 is an exploded perspective view of FIG. 4, with the object to be driven in cut-out view.
Figure 6:
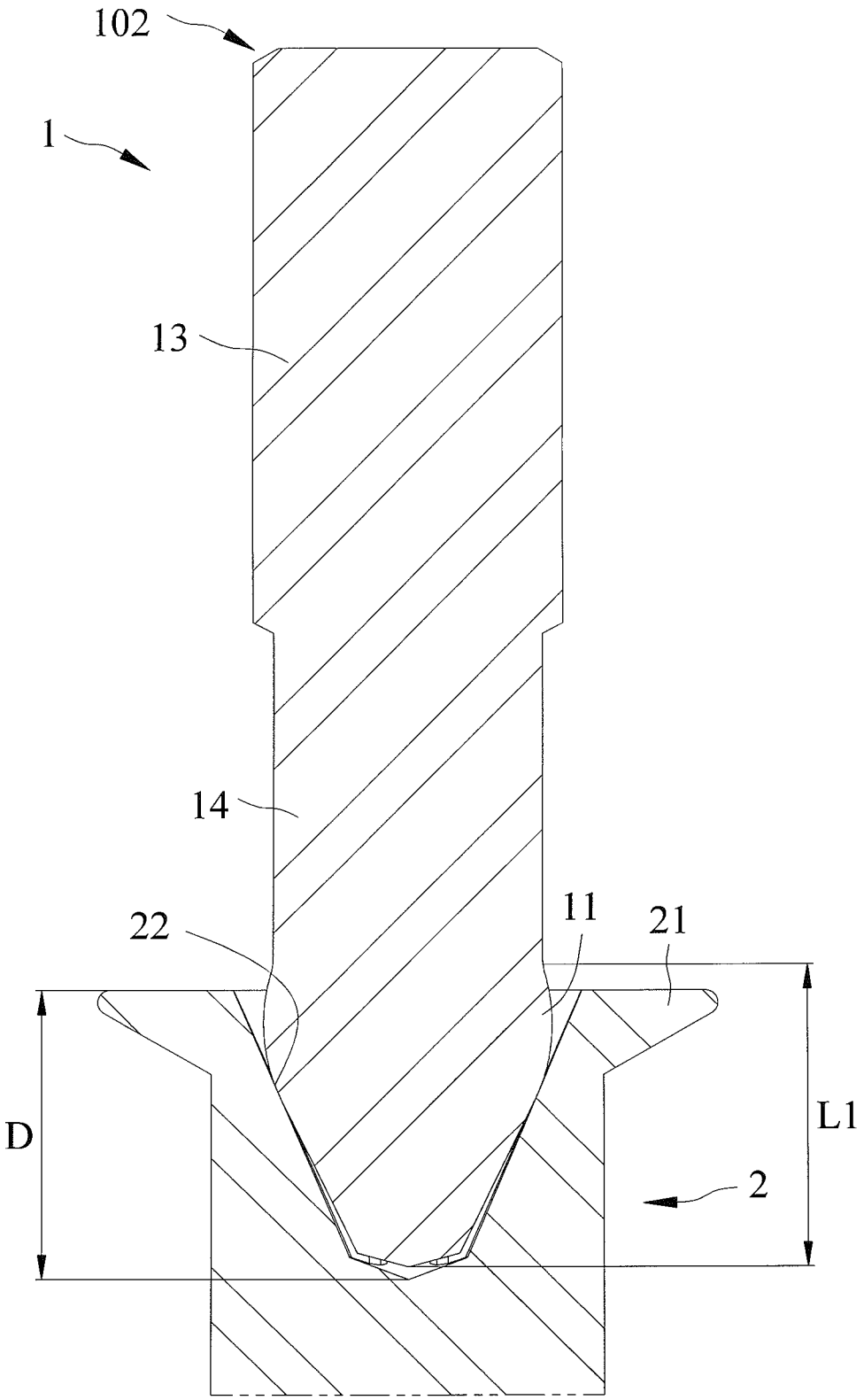
FIG. 6 is a cross-sectional view taken along line 6-6 of FIG. 4.

FIGS. 4 through 6 show the tool bit 1 engaging with an object 2 to be driven. The object 2 includes a head 21 and a slot 22 inset from the head 21. The depth that the slot 22 inset in the object 2 is D. The depth D is greater than the first length L1. The driving end 101 of the tool bit 1 and the slot 22 have shapes corresponding to each other. The plurality of fins 11 can be inserted into the slot 22, and each of the plurality of fins 11 has a greater portion received in the slot 22 than exposed outside when the tool bit 1 drives the object 2. Therefore, the second end 112 of each of the plurality of fins 11 tool bit 1 and the curved periphery 121 of the recess 12 extended therefrom are able to disposed as close as possible to the head 21 of the slot 22 when the tool bit 1 drives the object 2. Additionally, each of the plurality of fins includes the reinforcing sections 113 extended therefrom exposed outside the slot 22 when the tool bit 1 drives the object, and the reinforcing sections 113 effectively improve the structure of the tool bit 1 and make it better withstand torque.

Figure 7:
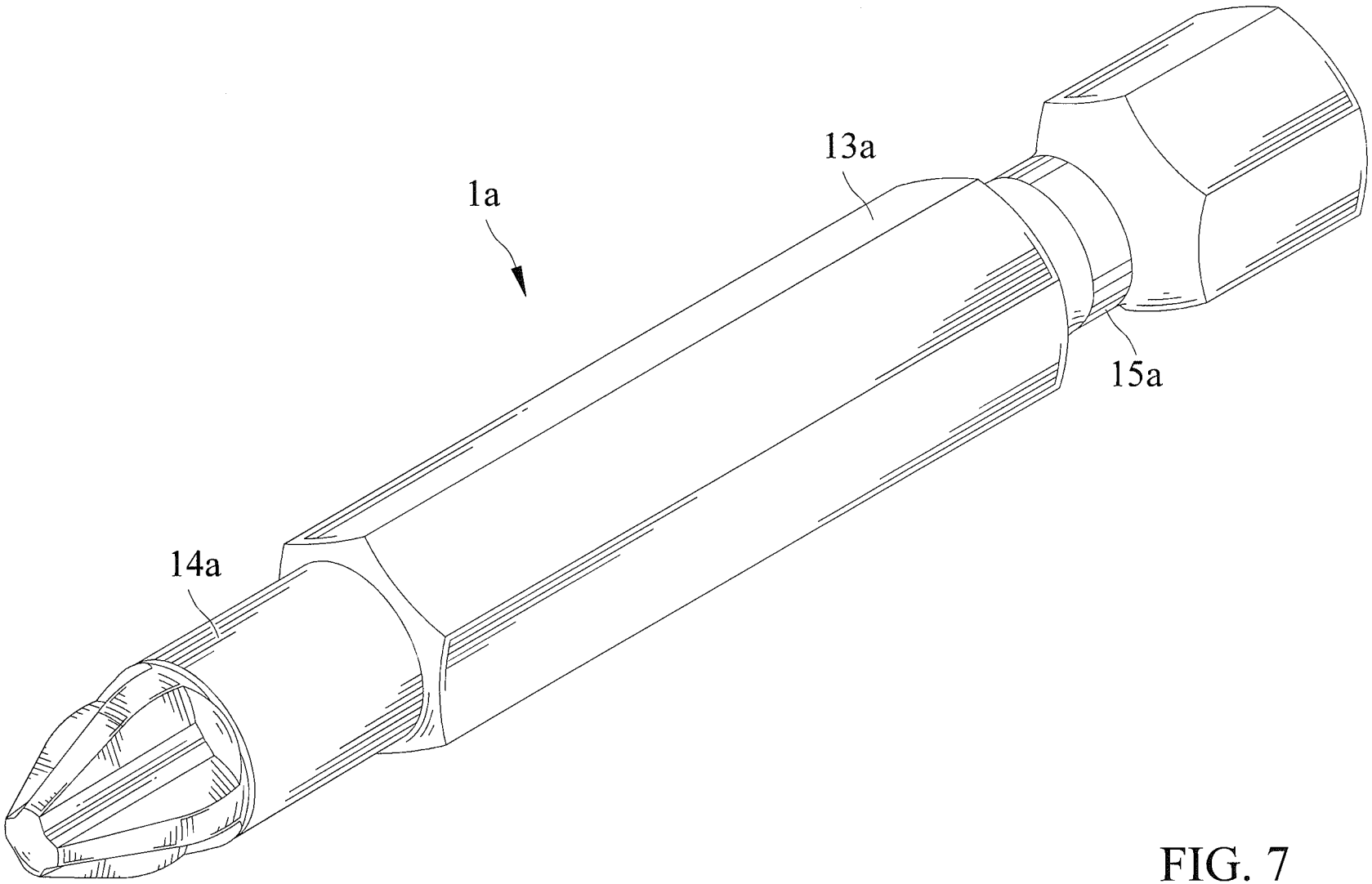
FIG. 7 is a perspective view of a tool bit in accordance with a second embodiment of the present invention.

FIG. 7 shows a tool bit la in accordance with a second embodiment of the present invention, and same numbers are used to correlate similar components of the first embodiment, but bearing a letter a. The second embodiment is similar to the first embodiment except that the tool bit la includes a connecting structure 13*a* including a groove 15*a* extended circumferentially thereon. The groove 15*a* is adjacent to an end of the connecting structure 13*a*, which is opposite to an end from which an extension 14*a* of the tool bit 1*a* extends. Additionally, the connecting structure 13*a* does have a plurality of notches inset thereon as in the first embodiment.

In view of the forgoing, the tool bits 1 and 1*a* can better withstand a high torque. Each of the plurality of the fins 11 includes an outer peripheral edge which extends obliquely and radially and which has a smaller gradient than that of conventional tool bits, thereby enabling the tool bit 1 to include each of the plurality of fins 11 having a greater length snugly fit with the object 2 to be driven when engaged together. Therefore, the tool bit 1 can engage quickly and fit steadily with the object 2 to be driven than the conventional tool bits, and it will not wobble on the object 2 inadvertently when it is driven, even at a rapid speed. Therefore, the tool bit is more suitable to use with power tools.

While the specific embodiments have been illustrated and described, numerous modifications come to mind without significantly departing from the spirit of invention, and the scope of invention is only limited by the scope of the accompanying claims.

What is claimed is:

1. A tool bit comprising:

a first end and a second end longitudinally opposite the first end respectively defining a driving end for engaging with an object to be driven and a connecting end adapted to engage with a driving tool, a plurality of fins each having a first end and a second end and formed on the driving end, with each of the plurality of fins extended radially and longitudinally from the first end to the second end thereof, with each of the plurality of fins including the second end thereof forming two opposite lateral sides each including a reinforcing section extended therefrom, with two adjacent fins of the plurality of fins forming a recess therebetween, with the recess having a curved periphery interconnecting two adjacent reinforcing sections of the two adjacent fins, with each of the plurality of fins defining a first length defining a distance from first end thereof to the curved periphery of the recess extended from the second end thereof, with the first length smaller than a second length defining a distance between two opposite peripheral sides of a hexagonal periphery of the connecting end, an extension extended from the second end of each of the plurality of fins to the connecting end, with the extension having a circular cross section, with each of the plurality of fins including the two reinforcing sections extended therefrom extending in a circumferential direction of the extension.

2. The tool bit as claimed in claim 1, wherein the first length ranges from 4.5 mm to 6.2 mm.

3. The tool bit as claimed in claim 2, wherein the first length is 4.5 mm.

4. The tool bit as claimed in claim 2, wherein the first length is 6.2 mm.

5. The tool bit as claimed in claim 1, wherein the second length ranges from 4 mm to 6.35 mm.

6. The tool bit as claimed in claim 5, wherein the second length is 4 mm.

7. The tool bit as claimed in claim 5, wherein the second length is 6.35 mm.

8. The tool bit as claimed in claim 1, wherein a connecting structure forms the connecting end, wherein the connecting structure includes a plurality of notches inset thereon, and wherein the notch is adapted to receive a detent mechanism of the driving tool.

9. The tool bit as claimed in claim 1, wherein a connecting structure forms the connecting end, and wherein the connecting structure includes a groove extended circumferentially thereon.

10. The tool bit as claimed in claim 1 when engaged with the object to be driven includes each of the plurality of fins having a greater portion received in a slot of the object to be driven than exposed outside.

11. The tool bit as claimed in claim 2 when engaged with the object to be driven includes each of the plurality of fins having a greater portion received in a slot of the object to be driven than exposed outside.

12. The tool bit as claimed in claim 5 when engaged with the object to be driven includes each of the plurality of fins having a greater portion received in a slot of the object to be driven than exposed outside.

13. The tool bit as claimed in claim 8 when engaged with the object to be driven includes each of the plurality of fins having a greater portion received in a slot of the object to be driven than exposed outside.

14. The tool bit as claimed in claim 9 when engaged with the object to be driven includes each of the plurality of fins having a greater portion received in a slot of the object to be driven than exposed outside.

* * * * *